US008506010B2

(12) United States Patent
Kane

(10) Patent No.: US 8,506,010 B2
(45) Date of Patent: Aug. 13, 2013

(54) SUBMERSIBLE PICNIC TABLE AND BENCH ASSEMBLY

(75) Inventor: Tom Kane, Acworth, GA (US)

(73) Assignee: Havin' Fun Products, LLC, Acworth, GA (US)

( * ) Notice: Subject to any disclaimer, the term of this patent is extended or adjusted under 35 U.S.C. 154(b) by 303 days.

(21) Appl. No.: 12/987,060

(22) Filed: Jan. 7, 2011

(65) Prior Publication Data

US 2012/0175919 A1 Jul. 12, 2012

(51) Int. Cl.
*A47B 83/02* (2006.01)

(52) U.S. Cl.
USPC ..... 297/158.3; 297/344.18; 4/495; 4/496

(58) Field of Classification Search
USPC ..... 297/158.3, 158.5, 344.18, 440.24; 4/494, 496; 441/130
See application file for complete search history.

(56) References Cited

U.S. PATENT DOCUMENTS

| | | | | | |
|---|---|---|---|---|---|
| 2,411,658 | A * | 11/1946 | La Rue | 297/158.5 |
| 4,008,497 | A * | 2/1977 | Badon | 4/487 |
| 4,330,151 | A * | 5/1982 | Healey | 297/158.3 |
| 5,352,015 | A * | 10/1994 | Morgan | 297/463.1 |
| 5,505,645 | A | 4/1996 | Engler, Jr. | |
| 5,785,379 | A * | 7/1998 | Pelletier | 297/158.5 |
| 5,823,121 | A | 10/1998 | Reiter | |
| 5,860,171 | A | 1/1999 | Hicks | |
| 5,953,767 | A * | 9/1999 | Cloffey | 4/487 |
| 6,808,434 | B1 | 10/2004 | Park | |
| 6,878,026 | B2 | 4/2005 | Cloutier | |
| 7,293,840 | B1 | 11/2007 | Schu | |
| 7,975,327 | B2 * | 7/2011 | Switzer | 441/130 |
| 2011/0185491 | A1 * | 8/2011 | Roberts | 4/496 |

* cited by examiner

*Primary Examiner* — Peter Brown
(74) *Attorney, Agent, or Firm* — Morris, Manning & Martin, LLP; John R. Harris

(57) ABSTRACT

A portable, submersible table and bench assembly suitable for use on land as well as in bodies of water having sloped or uneven bottom surfaces. The table and bench assembly includes a pair of benches and a central table mounted on a support frame that includes a plurality of hollow, adjustable support members or legs that are slidably received within the support frame. The hollow, adjustable support members extend downwards for contact with the ground or a sloped bottom swimming pool. The support frame includes a plurality of spaced apart perforations on the surface of downwardly extending risers that allow the entry and drainage of water, as well as adjustment of the height of the adjustable support members or legs. In addition to being light and portable, the hollow structure permits water to enter and drain through perforations and accordingly resist buoyancy when the table is immersed in water.

19 Claims, 10 Drawing Sheets

SUBMERSIBLE PICNIC TABLE AND BENCH ASSEMBLY

TECHNICAL FIELD

The present invention relates generally to recreational furniture, and more particularly relates to a tilt-adjustable, submersible picnic table and bench assembly suitable for outdoor recreational use in a body of water with a sloped or uneven bottom.

BACKGROUND OF THE INVENTION

On hot, sunny days, many people like to enjoy food and beverage while relaxing in a cool body of water such as a swimming pool, beach, or lake. Various types of outdoor furniture suitable for immersion in a body of water are known in the art. Typically, outdoor furniture designed for use in water comprises of some kind of floatable cushion or mattress, or some flotation mechanism, or is heavy enough to remain stable while resting on the bottom of the pool, lake, or beach. However, because of buoyancy and wave action, these types of furniture articles have a tendency to bob in different directions in the water, drift away, or feel unstable, unless they are tethered somehow or made heavy enough to stay in position.

Other known types of submersible furniture includes devices that are supported on the sides of swimming pools, or comprise heavy, weighted tables that are resistant to wave action but necessarily are difficult to move or reposition because of their weight.

U.S. Pat. No. 5,505,645 shows a floatable assembly for swimming pools. Such a floatable assembly is susceptible to wave action and would not be a stable surface for supporting food or drink.

U.S. Pat. No. 5,860,171 shows a suspended detachable swimming pool accessory that is not adaptable to sloping bottom.

U.S. Pat. No. 5,823,121 shows a spa table that is portable and has a self adjusting height that increases and decreases with the height of the water surface.

U.S. Pat. No. 6,808,434 shows a buoyant chair and table ensemble that is a floating device.

U.S. Pat. No. 6,878,026 shows an amphibious table with seats attached that includes a buoyant floating body.

U.S. Pat. No. 7,293,840 shows a swimming pool furniture item that has a vented assembly that can be submerged, with water inlets that receive water into the cavity of a frame. However, water must be removed by use of a vacuum system.

A desirable feature of outdoor recreational furniture is portability that would provide ease in handling, moving, and storage. This generally implies that the furniture should not be extremely heavy, but should rather be light in weight. At the same time, it is preferred that such furniture be comfortable, sturdy, be able to withstand substantial weight.

One particular issue with the use of submersible furniture in many swimming pools, lakes, and beaches is the presence of a sloped or uneven bottom. Most conventional submersible furniture relies upon flotation to compensate for a sloping or uneven bottom. A table having legs of even height would not be adaptable to such a sloping or uneven bottom and would result in a tilted table surface, which is undesirable for holding food, beverages, or gaming articles on a level surface.

Accordingly, there is a long-felt but unresolved need for submersible furniture with adjustable legs suited for use generally in a pool or other body of water with an uneven or sloping bottom, but is also easily movable and portable.

Simultaneously, such furniture should be comfortable, durable, cost-effective to manufacture, lightweight, and easy to assemble and disassemble.

BRIEF SUMMARY OF THE DISCLOSURE

Briefly described, and according to one embodiment, aspects of the present disclosure generally relate to a portable, tilt-adjustable, non-buoyant submersible recreational furniture article for placement along a sloped bottom surface of a body of water. The disclosed furniture article is a picnic table having a table top and a pair of benches on opposite sides of the table.

According to an aspect, the furniture article comprises a substantially hollow support frame for mounting a plurality of planar members that form the table top and benches. A plurality of openings are defined in the hollow support frame for allowing entry of water into the hollow support frame and thereby reduce buoyancy when the article is placed into the body of water. The openings facilitate drainage of water when the table is to be removed from the water.

The furniture article further comprises a plurality of substantially hollow lower support members or legs slidably received into the hollow support frame, each of the hollow lower support members including one or more openings to allow entry of water into the frame and drainage of water when the article is removed from the body of water. Means are provided for affixing one or more of the hollow lower support members or legs at a predetermined adjustable height relative to the hollow support frame to adjust the tilt angle of the support frame and table top. Preferably, the height adjustability is provided by a hitch pin that is received in and through a pair of spaced apart holes or openings in a downwardly extending part of the support frame.

According to an aspect, the plurality of openings in the hollow support frame are spaced apart extending along the length of a surface of the support frame. In the disclosed embodiment, the hollow support frame comprises a pair of end assemblies connected by a table support subassembly that supports the table top. Openings for entry and drainage of water are provided in various locations in the end assemblies and in the table support subassembly. Each end assembly of the hollow support frame comprises an inverted "U" shaped portion having a pair of downwardly extending hollow table risers. In the described embodiment, each of the hollow table risers slidably receives one of the lower support members or legs, and fastens the lower support members or legs at a predetermined height to adjust the tilt and height of the table.

According to yet another aspect, the table support subassembly includes at least one tubular supporting member extending between and supporting the pair of end assemblies. Furthermore, the table support subassembly also includes a plurality of openings defined therein for allowing entry and drainage of water into the hollow support frame.

Further still, the disclosed furniture article comprises at least one bench support assembly connected to the hollow support frame for supporting a seating bench at a height suitable for persons sitting at the table. The bench support assembly preferably also comprises a plurality of tubular members for supporting the seating bench and at least one bench riser. Each of the bench risers slidably receives one of the lower support members or legs with the height adjustability aspect.

Collectively, the table risers and bench risers and their respective lower support members or legs allow for great versatility in adjusting to an uneven or sloped bottom of the body of water. Further, the support members allow water to quickly enter the support frame to reduce buoyancy and also to drain quickly when the table is moved or removed from the water.

In the disclosed embodiment, the hollow support frame and lower support members comprise PVC tubular members connected by elbows and tee joints.

According to yet another aspect, the table support subassembly includes a central umbrella riser for receiving and supporting a sun umbrella.

These and other aspects, features, and benefits of the claimed invention(s) will become apparent from the following detailed written description of the preferred embodiments and aspects taken in conjunction with the following drawings, although variations and modifications thereto may be effected without departing from the spirit and scope of the novel concepts of the disclosure.

BRIEF DESCRIPTION OF THE DRAWINGS

The accompanying drawings illustrate one or more embodiments and/or aspects of the disclosure and, together with the written description, serve to explain the principles of the disclosure. Wherever possible, the same reference numbers are used throughout the drawings to refer to the same or like elements of an embodiment, and wherein.

DETAILED DESCRIPTION

Figure 1:
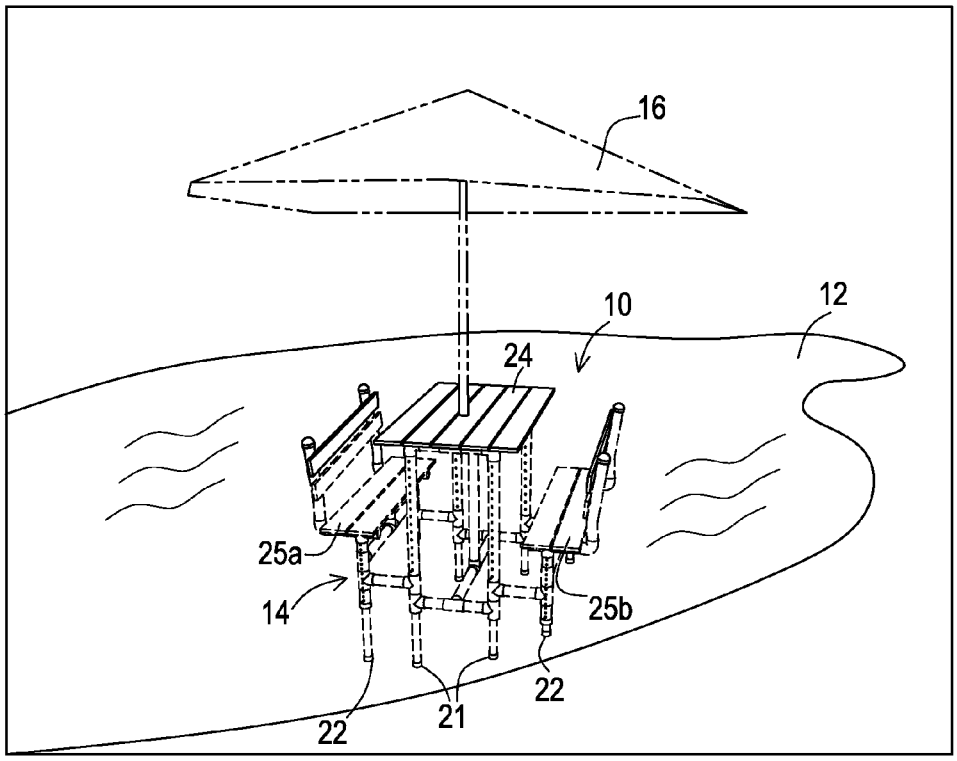
FIG. 1 is a perspective view of one embodiment of a submersible picnic table and bench assembly constructed as described herein, partially submerged in a body of water.

For the purpose of promoting an understanding of the principles of the present disclosure, reference will now be made to the embodiments illustrated in the drawings and specific language will be used to describe the same. It will, nevertheless, be understood that no limitation of the scope of the disclosure is thereby intended; any alterations and further modifications of the described or illustrated embodiments, and any further applications of the principles of the disclosure as illustrated therein are contemplated as would normally occur to one skilled in the art to which the disclosure relates. All limitations of scope should be determined in accordance with and as expressed in the claims.

Turning now to the drawings, in which like reference numerals indicate corresponding elements throughout the several views, attention is first directed to FIG. 1 which shows a picnic table and bench assembly generally designated as 10 constructed in accordance with aspects of the present invention, submerged in a body of water 12 such as a swimming pool, lake, or at the beach. In accordance with aspects of the invention, as will be described, the table 10 submerges within the water 12 with the table top 24 shown above the water line, having a pair of benches 25*a*, 25*b* for seating, immersed within the water. Advantageously, this allows persons (not shown) to be seated on a bench 25 while partially immersed in the water, but enjoy a beverage, food, or game on the table top 24. The table top 24 and benches 25 are generally supported and mounted on a frame 14, which is submersible and floodable to reduce buoyancy, but readily drainable for ease of movement and removal from the water.

Of further advantage, and in accordance with aspects of the invention, the angle of the table 10 is adjustable, as will be described, by adjustment of a plurality of table legs 21 and bench legs 22, to compensate for a sloped or angled bottom of the body of water 12. Of still further advantage, and as will be described, the frame 14 is constructed to readily fill with water to reduce buoyancy, with features designed to rapidly drain the water when the table 10 is removed from the water.

Still referring to FIG. 1, a sun umbrella 16 (shown in phantom) can be supported in the table 10 to provide for shade.

Figure 2:
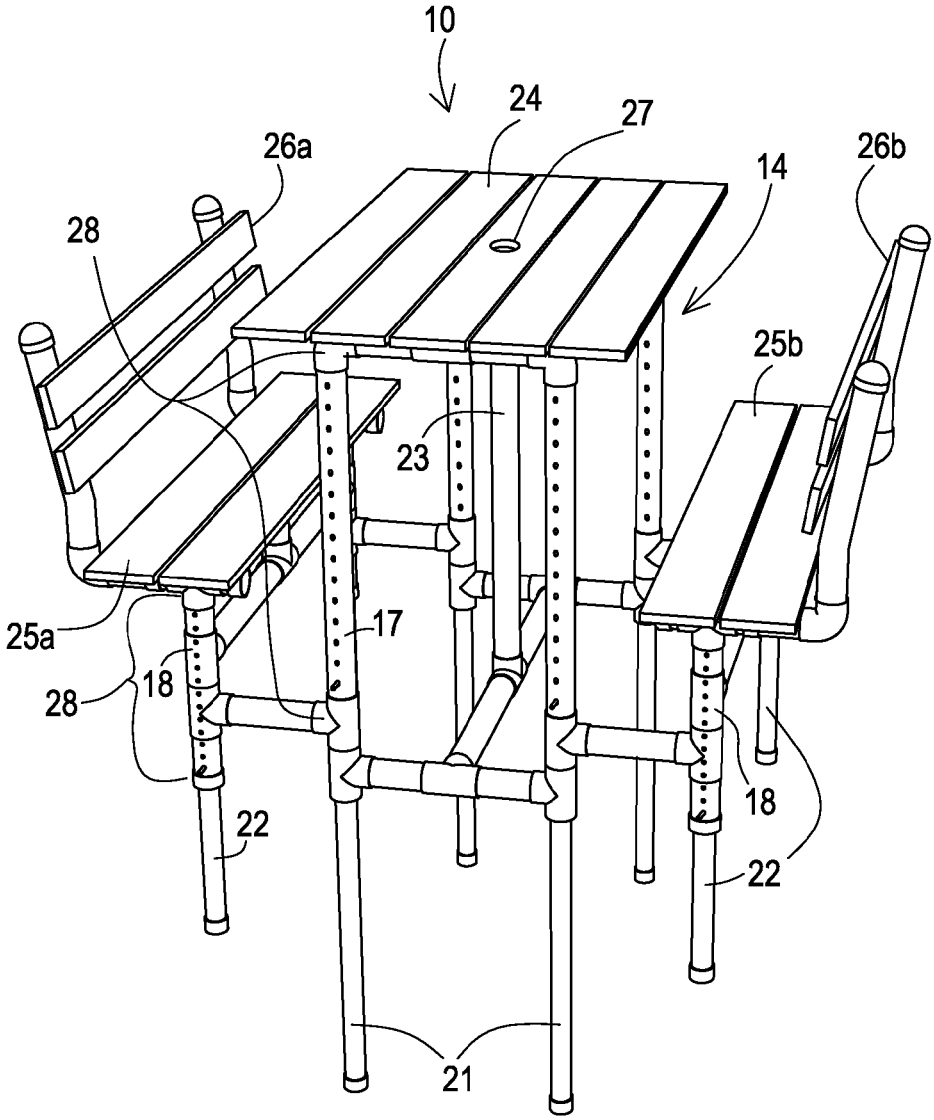
FIG. 2 is a perspective view of the embodiment of FIG. 1, showing more details.

FIG. 2 is a detailed perspective view of an embodiment of the picnic table and bench assembly 10 showing the benches 25 and the table top 24, both of which are mounted on a portion of the frame 14. The benches 25*a*, 25*b* are mounted immediately atop a plurality of bench risers 18 that receive and retain slidably adjustable bench legs 22. Similarly, the table top 24 is mounted above a plurality of table risers 17 that receive and retain slidably adjustable table legs 21, respectively. In the disclosed embodiment, there are four (4) bench risers 18, four (4) legs 22, four (4) table risers 17, four (4) legs 21, and eight (8) leg bushings 728 (see FIG. 7) arranged to construct a stable table mounting. Each of the legs 21, 22 provide telescopic height adjustment to various heights to allow for adjustment of the table relative to a sloped or uneven bottom of the body of water.

According to one aspect, the benches 25 have angled bench backs 26, inclined at a suitable angle to the vertical axis. According to another aspect, the table top 24 includes an umbrella holder opening 27 through which an umbrella can be inserted to fit inside a tubular umbrella holder 23 formed as part of the frame 14.

According to an aspect, the frame 14 is constructed of tubular polyvinyl chloride (PVC) pipes, with the adjustable legs 21, 22 slidably received within the table risers 17 and bench risers 18, respectively, of slightly larger diameter. The frame 14 includes a plurality of holes or openings 28 defined in the table risers 17 and bench risers 18 that serve a dual purpose of allowing slidable adjustment to adjust the angle of the table relative to a sloped bottom, as well as allowing water to enter and flood the tubular structure to reduce buoyancy. As shown, the holes or openings 28 are arranged in a linear array on each of the table risers 17 and bench risers 18 to allow a variable height adjustment of the respective adjustable legs.

Although the frame 14 is shown as round tubes as the disclosed and preferred embodiment, it will be appreciated that other types of hollow structural members, such as tubes with a square or other geometrical shaped cross-section can be used according to various embodiments.

Figure 3A:
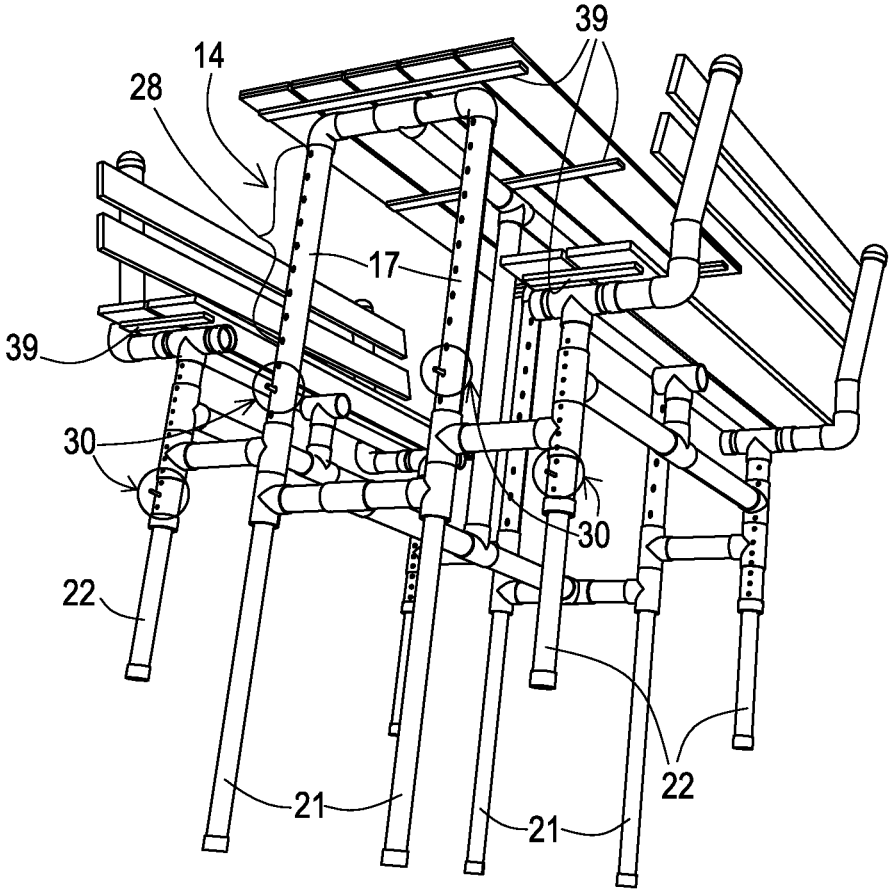
FIG. 3A is a front perspective view of the embodiment of FIG. 1 viewed from underneath, with a particular portion of an adjustable leg magnified in FIG. 3B for illustrating details.

FIG. 3A is a perspective underside view of the picnic table and bench assembly 10. This view reveals a plurality of slats 39 located on the underside of the benches 25 and the table top 24. The slats 39 extend across and are fastened to the widths of a plurality of elongate planar planks or boards that form the table top 24 and benches 25. In the disclosed embodiment, the planks or boards are wood or plastic composite material such as TREX® composite decking, manufactured by Trex Company, Inc. Alternatively, a single planar member can be used for the table top or bench seats.

Figure 3B:
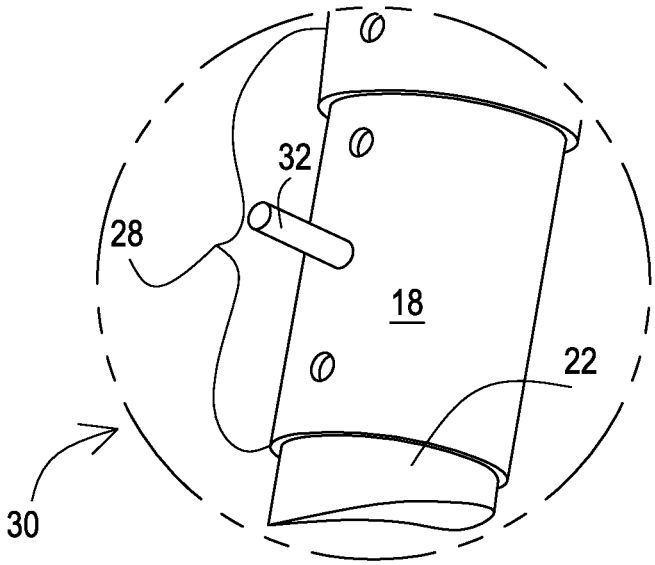
FIG. 3B is a magnified view of a portion of one lower adjustable leg that illustrates the manner in which the lower leg is slidably received and held with a pin.

FIG. 3B is an enlarged view of a portion of a bench riser 18 (with a table riser 17 being similarly constructed). The bench riser 18 slidably receives and retains a leg 22 in a predetermined position, at a predetermined but selectable height, as determined by placement of a pin 32 that extends through a pair of opposing holes in the array of holes 28 on the bench riser 18. Although not shown in the figure, it is understood that the leg 22 is prevented from falling out at the top most end by the placement of a hidden screw (not shown) such that the head of the screw abuts a bushing (i.e., bushing 728 in FIG. 7), thereby preventing its inadvertent removal. Preferably the pin 32 is a cotterless hitch pin that passes through a selected pair of openings 28 in the bench riser 18 and its corresponding table leg 22, and locks to set the height of leg. In accordance with an aspect of the invention, such adjustability is greatly advantageous when the picnic table and bench assembly 10 is used in a swimming pool or lake with a sloped bottom. The height of the plurality of bench legs 22 and table legs 21 can be adjusted according to the slope of the bottom of the pool. Because there are eight (8) total legs in the disclosed embodiment, it will be appreciated that the table and bench assembly 10 is also adaptable to be leveled in a body of water with an uneven bottom, in addition to a planar or evenly sloped bottom.

According to an aspect of the invention, the frame 14 with bench risers 18, table risers 17, legs 21 and 22 are flooded with water through the holes 28 when the table 10 is placed into the body of water. Water enters the cavities of the tubular members of the frame 14 through the various openings 28 in the frame, as will be shown, for the purpose of reducing buoyancy. Reduction of buoyancy helps keep the table assembly 10 partially submerged.

Figure 4:
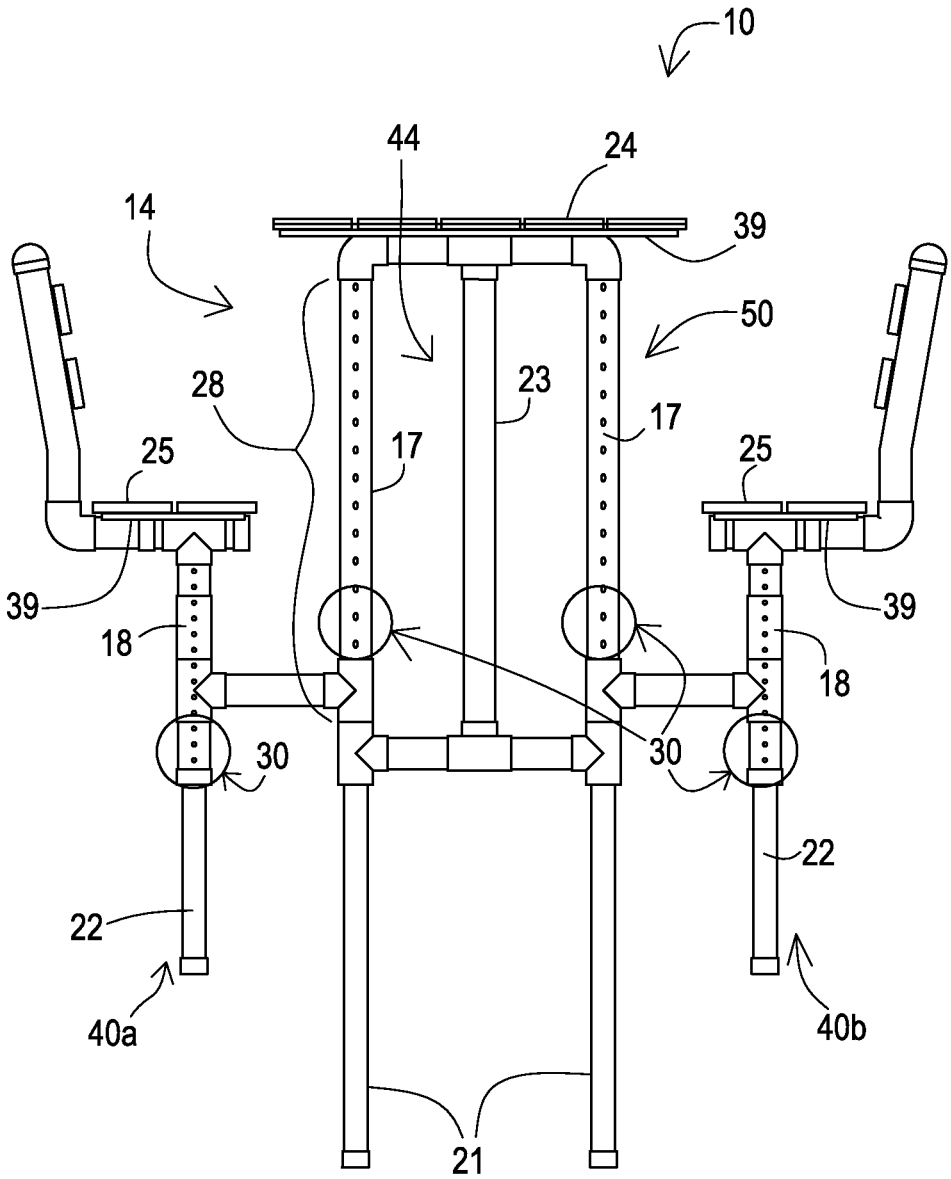
FIG. 4 is a side view of the embodiment of FIG. 1.
Figure 5:
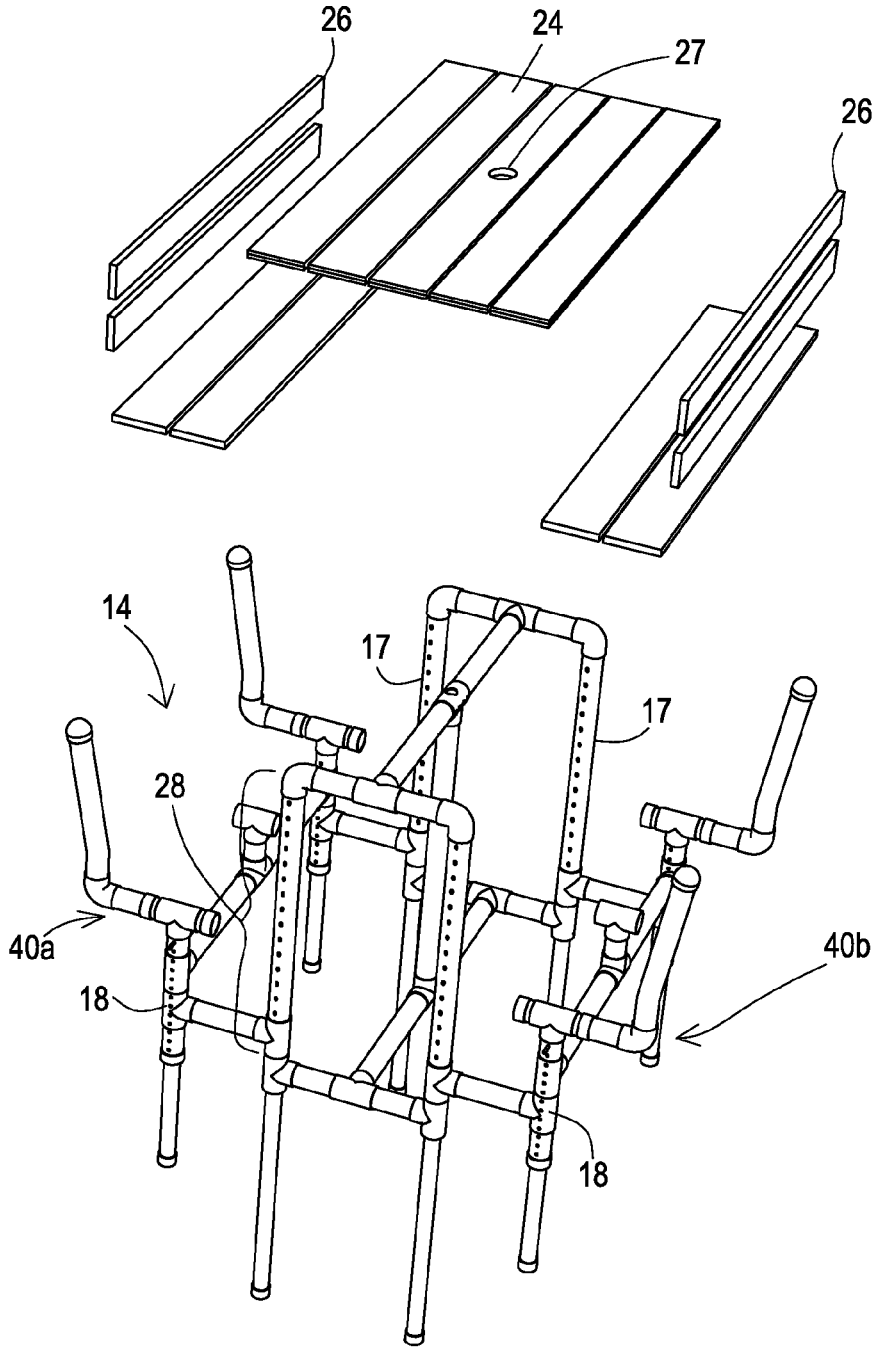
FIG. 5 is a partially exploded perspective view of the embodiment of FIG. 1, without the table top or benches attached.

FIG. 4 and FIG. 5 show a side view and a partially exploded view, respectively, of the picnic table and bench assembly 10, showing one of a pair of identical end assemblies 50 of the frame assembly 14. As described in further detail below, each end assembly 50 includes a pair of identical bench support subassemblies 40*a*, 40*b* and a central table support assembly 44. Each of pair of bench support subassemblies 40*a*, 40*b* supports the benches 25 and an adjustable leg 22, while the table support assembly 44 supports the table top 24 and a pair of adjustable legs 21.

Figure 6:
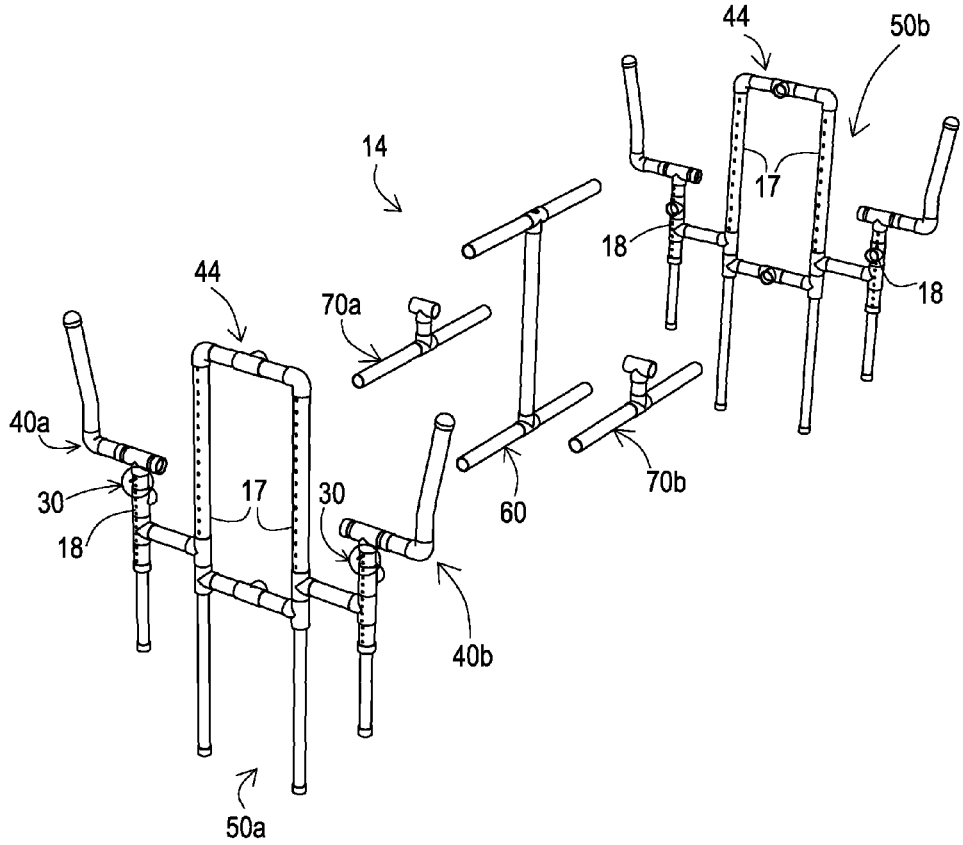
FIG. 6 is a partially exploded perspective view of the support frame of the embodiment of FIG. 1, showing two side-assemblies, along with a table-support subassembly and a bench-support subassembly.

FIG. 6 shows yet another view of the frame 14 of the disclosed table and bench assembly 10, showing the pair of identical end assemblies 50*a*, 50*b* that include the table risers 17 and bench risers 18, which are connected and coupled by a table support subassembly 60 and a pair of identical bench support subassemblies 70*a*, 70*b* that extend between the two end assemblies 50*a*, 50*b*. These subassemblies 60, 70 are illustrated in more detail in FIG. 8 and FIG. 9 respectively.

Figure 7:
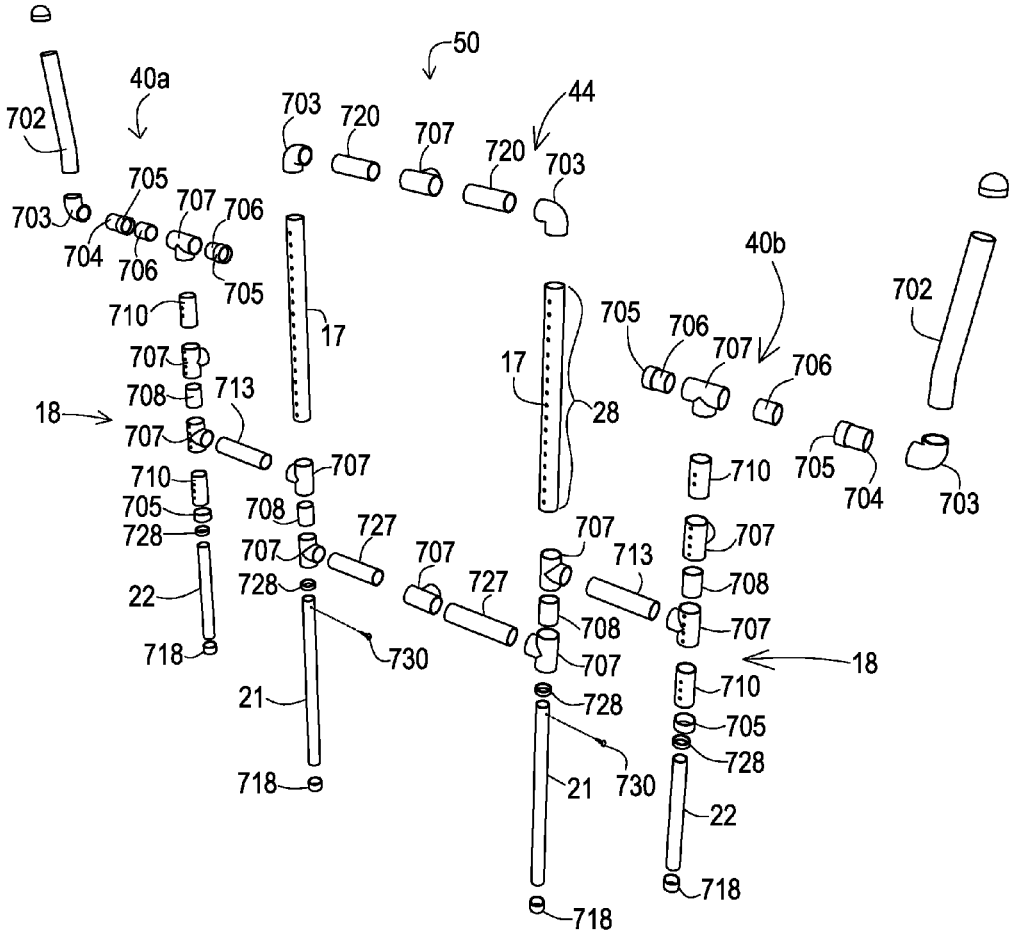
FIG. 7 is an exploded view of a portion of the support frame assembly of the embodiment of FIG. 1.

Referring now to FIG. 7, one of the pair end assemblies 50 of the supporting frame assembly 14 of the picnic table and bench assembly 10 is shown in exploded detail. Most of the components shown in this figure are made of PVC, polyethylene, other type of plastic, or other similar light-weight material that can form a tubular hollow structure. Each end assembly 50 comprises a pair of mirror image bench support assemblies 40*a*, 40*b*, and a table support assembly 44. Each bench support assembly 40 comprises a bench riser 18 that receives and supports an adjustable bench leg 22, while the table support assembly 44 comprises a pair of table risers 17 that receives and supports a pair of adjustable table legs 21. Each table leg 21 and bench leg 22 are fitted at their lower end with a tubular bottom or foot cap 718 that includes a hole or perforations for the drainage of water.

As discussed above, and according to an aspect of the invention, the table risers 17 and bench risers 18 all preferably have perforations or openings 28 extending in a linear array on their surface to allow for height adjustability of their respective legs. Each table leg 21 and bench leg 22 are slidably received within the larger diameter of their table riser 17 and a bench riser 18 respectively. Since the interior of the table legs 21 and the bench legs 22 are hollow, as are the table risers 17 and bench risers 18, water can flow into and out of the cavities or holes 28 defined in the table and bench risers, and also drain from the bottom cap 718. Additionally, and as shown and described above in connection with FIG. 3B, these holes 28 receive a cotterless hitch pin 32 for adjusting the height of the table leg 21 and the bench leg 22 when placed on a sloped bottom of a body of water.

Still referring to FIG. 7, each end assembly 50 comprises a plurality of tubular members made of conventional PVC piping material, assembled with elbows 703, couplers 705, and tees 707 that are configured to make the various elements of the overall assembly, including table risers 17, bench risers 18, legs 21, 22, and end assemblies 50. FIG. 7 illustrates the components of one of the end assemblies 50, it being understood that a pair of end assemblies 50*a*, 50*b* are utilized in constructing the frame 14. The components illustrated are fastened using glue or adhesive suitable for assembling PVC piping, or may be bolted or screwed together, or may be heat fused.

According to the disclosed embodiment, the bench support assemblies 40*a*, 40*b* are mirror images of each other, and each assembly 40 comprises an angled backrest upright 702 that is coupled via an elbow 703 to a backrest extension 704, a coupler 705, a bench extension 706, a tee 707, and, another bench extension 706. The tee 707 of the bench support assembly 40 is connected at its orthogonal junction to the bench riser 18, which comprises a riser extension 710, a pair of serially connected tees 707, a tee connector 708 in between the serially connected tees 707 and another riser extension 710. At the lower end of the bench riser 18, another coupler 705 is provided, which terminates in a leg bushing 728 which receives the upper end of an adjustable leg 22. The diameters of the riser extension at the lower end of the bench riser 18 and the leg bushing 728 are larger than the diameter of the adjustable leg 22 so that the leg 22 is slidable within the bench riser 18. A hidden screw 730 is affixed to the upper end of each leg 21, 22 after insertion of the leg through a bushing 728 so that the head of the screw abuts the bushing when in the most extended position and thereby prevents inadvertent removal or falling out of the leg.

Further according to the disclosed embodiment, the table support assembly 44 comprises an inverted "U" shape, with the connection portion of the "U" at the upper end for supporting the table top 24 (See FIG. 1), and also including a cross-strut about halfway along the length of the "U". The connecting portion of the "U" of the table support assembly 44 comprises a pair of elbows 703, a pair of table extensions 720, and a tee 707 in between. The downward legs of the "U" comprise tubular table risers 17 extending downward from the connecting portion of the "U", a pair of serially connected tees 707, and a leg bushing 728. As in the bench risers 18, the diameters of the table riser 17 and the leg bushing 728 are larger than the diameter of the adjustable leg 21 so that the leg 21 is slidable within the table riser 17. The leg bushing 728 is inserted inside the tee 707. The legs 21 and 22 are stabilized by the leg bushing 728.

Still referring to FIG. 7, the orthogonal junctions of serially connected tees 707 at the lower end of the table riser 17 are used connect to other supporting members for structural strength and integrity. The uppermost tee 707 of the pair of tees is connected via a bench-to-table connector 713 to the bench support assembly 40, while the lowermost tee 707 is connected to a table crossbrace extension 727 which bridges the legs of the "U" of the table support assembly 44. Preferably a pair of table crossbrace extensions 727 are provided, connected by a tee 707 in the middle.

Figure 8:
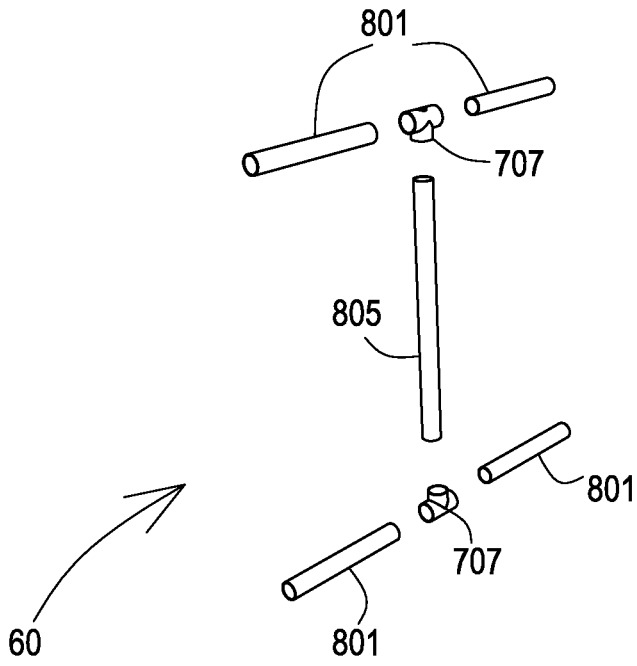
FIG. 8 is an exploded view of the table-support subassembly of the embodiment of FIG. 1.

FIG. 8 illustrates a table support subassembly 60. As best seen in FIG. 6, the table support subassembly 60 is positioned between and connects a pair of end assemblies 50*a*, 50*b* to form the frame 14. The table support subassembly is generally a rotated "H" shape, with the legs of the "H" connecting to the middle tees in the table support assembly 44. The table support subassembly 60 comprises a plurality of table cross support extensions 801, a pair of tees 707, and an umbrella riser 805 coupled to the orthogonal junctions of the tees, to form the connecting portion of the "H".

Advantageously, and according to an aspect, a recreational sun umbrella 16 (shown in phantom in FIG. 1) can be slidably received in the umbrella riser 805 by insertion through the umbrella holder opening 27 (FIG. 2).

Figure 9:
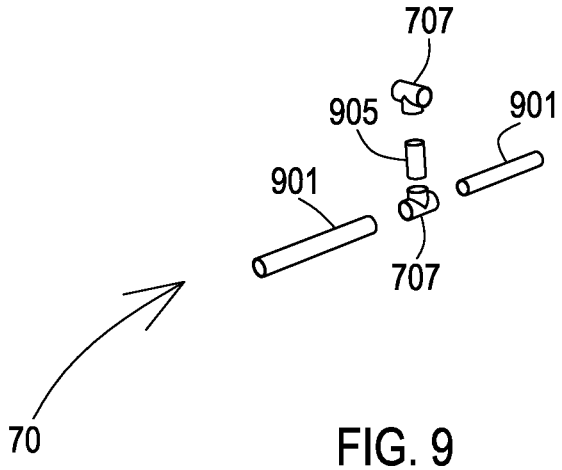
FIG. 9 is an exploded view of the bench-support subassembly of the embodiment of FIG. 1.

FIG. 9 illustrates a bench-support subassembly 70. As best seen in FIG. 6, the bench support subassembly 70 is positioned between and connects a pair of end assemblies 50*a*, 50*b* to form the frame 14. The bench support subassembly 70 comprises a pair of bench cross-support extension members 901, with a tee 707 positioned in between. A bench cross-support riser 905 is attached at the orthogonal junction of the tee 707 and supports another tee 707 which abuts the planks or boards of the bench 25.

The foregoing description of the exemplary embodiment has been presented only for the purposes of illustration and description and is not intended to be exhaustive or to limit the inventions to the precise forms disclosed. Many modifications and variations are possible in light of the above teaching.

The disclosed embodiment is described in order to explain the principles of the inventions and their practical application so as to enable others skilled in the art to utilize the inventions and various embodiments and with various modifications as are suited to the particular use contemplated. Alternative embodiments will become apparent to those skilled in the art to which the present inventions pertain without departing from their spirit and scope. Accordingly, the scope of the present inventions is defined by the appended claims rather than the foregoing description and the exemplary embodiments described therein.

What is claimed is:

1. A portable, tilt-adjustable, non-buoyant submersible recreational furniture article for placement along a sloped bottom surface of a body of water, comprising:

a substantially hollow support frame for mounting a table top and a pair of bench seats, said support frame comprising a table support assembly for supporting a table top and a pair of bench support assemblies positioned on opposite sides of said table top, each for supporting a bench seat, said table support assembly comprising a plurality of downwardly extending hollow table risers made of a lightweight plastic material, said hollow table risers including a plurality of spaced-apart openings defined in and extending along a substantial extent of the length of said hollow table risers for allowing entry and drainage of water to reduce buoyancy when the article is placed into the body of water, said bench support assembly comprising a plurality of downwardly extending hollow bench risers also made of a lightweight plastic material, said hollow bench risers also including a plurality of spaced-apart openings defined in and extending along a substantial extent of the length of said hollow bench risers for allowing entry and drainage of water to reduce buoyancy when the article is placed into the body of water;

a plurality of substantially hollow lower support members slidably received into said downwardly extending bench risers and said downwardly extending table risers, each of said hollow lower support members including one or more openings to allow entry and drainage of water to reduce buoyancy when the article is placed into the body of water; and a plurality of support pins for affixing each of said hollow lower support members at a predetermined adjustable height relative to said downwardly extending bench risers and table risers to adjust a tilt angle of said support frame.

2. The furniture article of claim 1, wherein the table top comprises a plurality of planar members that define a table surface.

3. The furniture article of claim 1, wherein each bench seat comprises a plurality of planar members that define a seating bench.

4. The furniture article of claim 3, wherein the plurality of planar members define a pair of seating benches positioned on opposite sides of said table top.

5. The furniture article of claim 1, wherein said hollow support frame comprises a pair of end assemblies connected by a table support subassembly.

6. The furniture article of claim 5, wherein the table support subassembly includes a central umbrella riser for receiving and supporting a sun umbrella.

7. The furniture article of claim 5, wherein each end assembly of said hollow support frame comprises an inverted "U" shaped portion having a pair of downwardly extending hollow table risers, and wherein each of said hollow table risers slidably receives one of said lower support members.

8. The furniture article of claim 5, wherein said table support subassembly includes at least one tubular supporting member extending between and supporting said pair of end assemblies.

9. The furniture article of claim 5, wherein said table support subassembly includes a plurality of openings defined therein for allowing entry and drainage of water into and out of said hollow support frame.

10. The furniture article of claim 1, wherein said hollow support frame and said lower support members comprise PVC tubular members connected by elbows and tee joints.

11. The furniture article of claim 1, further comprising a drainage cap affixed to the bottommost end of each of said lower hollow support members for allowing entry and drainage of water.

12. The furniture article of claim 1, wherein said hollow support frame comprises a pair of end assemblies connected by a table support subassembly.

13. The furniture article of claim 12, wherein the table support subassembly includes a central umbrella riser for receiving and supporting a sun umbrella.

14. The furniture article of claim 12, wherein each end assembly of said hollow support frame comprises an inverted "U" shaped portion having a pair of downwardly extending hollow table risers, and wherein each of said hollow table risers slidably receives one of said lower support members.

15. The furniture article of claim 12, wherein said table support subassembly includes at least one tubular supporting member extending between and supporting said pair of end assemblies.

16. The furniture article of claim 12, wherein said table support subassembly includes a plurality of openings defined therein for allowing entry and drainage of water into said hollow support frame.

17. The furniture article of claim 1, wherein each of said bench support assemblies comprises at least one horizontally extending tubular member mounted between at least one pair of hollow bench risers for supporting a seating bench.

18. The furniture article of claim 1, wherein said hollow support frame and said lower support members comprise PVC tubular members connected by elbows and tee joints.

19. A portable, angle-adjustable, non-buoyant, submersible recreational furniture article for placement along a sloped bottom surface of a body of water, comprising:

a support frame comprising a plurality of substantially hollow first vertical tubular members each having an elongate body made of a lightweight plastic material;

a substantially hollow second vertical tubular member slidably received into the elongate body of each first vertical tubular member, each of said second vertical tubular members also made of a lightweight plastic material;

at least one radially extending pin-receiving opening defined in each of said first vertical tubular members for receiving a height-adjustment support pin;

a plurality of radially extending spaced-apart pin-receiving openings defined along a substantial extent of the length each of said first vertical tubular members for receiving said height adjustment support pin and for allowing entry and drainage of water to reduce buoyancy when the article is placed into the body of water;

a water-draining opening defined in the bottommost extent of each of said second vertical tubular members;

at least one first tubular horizontal support member positioned between a pair of said first vertical tubular support members for mounting a table top; and at least one second tubular horizontal support member positioned between a pair of said first vertical tubular support members at a height beneath that of said first tubular horizontal support members for mounting at least one bench seat, whereby the angle of the table top is adjusted by adjusting the height of one or more second vertical tubular members relative to their respective first vertical tubular members to adjust for the sloped bottom surface of the body of water, and whereby water enters said pin-receiving openings of said first vertical tubular members and said water-draining openings of said second vertical tubular members upon placement of the article into the body of water to reduce buoyancy, and whereby water exits said pin-receiving openings and said water-draining openings upon removal of the article from the body of water.

* * * * *